US007082639B2

(12) United States Patent
Hansen

(10) Patent No.: US 7,082,639 B2
(45) Date of Patent: Aug. 1, 2006

(54) BRUSH OPTIMIZER

(75) Inventor: Karl R. Hansen, Cottage Grove, MN (US)

(73) Assignee: Tennant Company, Minneapolis, MN (US)

( * ) Notice: Subject to any disclaimer, the term of this patent is extended or adjusted under 35 U.S.C. 154(b) by 690 days.

(21) Appl. No.: 10/139,094

(22) Filed: May 4, 2002

(65) Prior Publication Data

US 2003/0074753 A1 Apr. 24, 2003

Related U.S. Application Data

(60) Provisional application No. 60/346,229, filed on Oct. 19, 2001.

(51) Int. Cl.
*A47L 11/00* (2006.01)

(52) U.S. Cl. ..... 15/49.1; 15/50.3; 15/78; 15/82; 15/98; 15/339; 15/370

(58) Field of Classification Search ..... 15/49.1, 15/52.1, 50.3, 98, 78–82, 339, 368, 370, 15/340.1–340
See application file for complete search history.

(56) References Cited

U.S. PATENT DOCUMENTS 4,272,695 A * 6/1981 Buchwald et al. ..... 310/242
4,356,671 A * 11/1982 Gabrielson et al. ..... 451/56
4,977,345 A * 12/1990 Toperzer ..... 310/242
5,014,387 A * 5/1991 Hays ..... 15/339

* cited by examiner

*Primary Examiner*—Gladys P. Corcoran
*Assistant Examiner*—Abrham Bahta
(74) *Attorney, Agent, or Firm*—Robert A. Pajak

(57) ABSTRACT

The present invention provides an improved mechanical coupling for rapidly adjusting the elevation of a working edge portion of a tool which working edge portion is subject to wear that decreases the effective length of the working edge portion. In one embodiment, the bristles of a drum-type brush comprise the working edge portion. Once the working edge is properly adjusted with respect to a work surface, the amount of downforce imparted by the working edge and the pattern of the working edge on a work surface are maximized. In use an operator compares the length of the working edge to a first indicia set displayed adjacent the working edge and adjusts the elevation of the working edge with reference to a second indicia set which corresponds to the first indicia set. Surface maintenance vehicles which support an adjustable height tool with a working edge that wears down may utilize the present invention. The work surface may comprise any finished or unfinished interior or exterior surface such as without limitation such surfaces covered with fabric, carpet, tile, wood, stone resin-based and plastic materials and the like.

45 Claims, 9 Drawing Sheets

BRUSH OPTIMIZER

STATEMENT OF RELATED APPLICATIONS

This application for utility patent coverage in the United States of America hereby incorporates by reference and, under 35 U.S.C. §119(e), claims the benefit of U.S. Provisional Patent Application No. 60/346,229 filed Oct. 19, 2001 and entitled, "Brush Optimizer."

FIELD OF THE INVENTION

The present invention relates generally to surface maintenance or conditioning vehicles and/or equipment, and particularly those vehicles employing one or more floor maintenance or conditioning appliances or tools that perform one or more tasks including, among others, scrubbing, sweeping, polishing or burnishing.

BACKGROUND OF THE INVENTION

Surface maintenance machines that support a work tool adapted to perform surface maintenance or surface conditioning tasks are, of course, well known. Such surface maintenance machines often have one or more motorized drivers coupled to a floor maintenance work tool for, among others, scrubbing, sweeping, polishing or burnishing. Also common to such machines is the need to set the elevation of the work tool, and/or pressure applied by the work tool, for example a brush, upon a floor or other work surface to be cleaned.

Sometimes the effective area of contact between the work tool and the work surface is referred to as the "pattern." To adjust the pattern, an operator typically scatters sand, powder or other granular material over a test area, lowers the brush to a lower limit of travel, operates and then raises the brush. The resulting pattern is then measured, and if needed, the lower limit of travel readjusted and the pattern measurement sequence performed over again. More specifically, industrial grade sweeper equipment commonly used a work tool in the form of a rotatable disk-type brush or rotatable drum-type brush. As can be easily understood for drum-type brushes used for such sweepers, as a work tool is lowered toward the floor the pattern increases as the bristles of a brush are bent or compressed toward the work surface. The brush pattern is of course dependent upon the resiliency of the brush bristles extending radially from the brush drum of a drum-type brush or the bristles extending transversely from a disk of a disk-type brush. This is the same scenario for cylindrical or drum-type brushes as well as all type of tools which move over a work surface. A common feature of such tools is a medium having a working edge portion that continuously wears thus decreasing the size of the pattern. This requires occasional adjustment of the tool to restore the pattern to its desired size.

As is known in the art, in order to consistently sweep a work surface an optimum adjustment of the work tool relative to the work surface is desirable. In the case of horizontally oriented drum-type brush assemblies, the spacing of the axis of rotation of the brush relative to the work surface largely determines brush pattern and resulting magnitude of downward pressure (or "downforce") that is applied to the work surface by the brush.

A tool, such as a drum-type brush, commonly is partially supported at some elevation above the work surface. When released from a support position, the state of the tool is termed "free float" which is useful for temporarily applying added downforce to a work surface by way of a controllable pivot-type mount or mechanism. Since such brushes are wear items—as the bristles gradually wear down over time—if the pattern is too large (i.e. the brush is applying too great a downforce) the ends of the bristles will rapidly and needlessly erode, damage to the work surface may occur and unnecessary stresses may be applied to a motor and mechanical components configured to power the brush. Indeed, with a pivot-type mount for such drum-type brushes, the brush may auger into the work surface with potential damage to the machine, the work surface and the operator.

More importantly, however is that as the bristles wear, the brush pattern gets smaller resulting in less of the work surface being cleaned as a vehicle is transported over the work surface.

In the past, an operator would manually adjust the spacing of the brush relative to the work surface based largely on a subjective evaluation of the proper spacing and on the operator's experience with the machine. The operator would set an initial spacing between the brush and the work surface. Then, with the brush rotating but the surface maintenance machine stationary, the operator would lower the brush, and sweep a small test area having a test material such as sand, powder, debris or the like strewn on the surface. After retracting the brush, the brush pattern (i.e., the area where the debris was removed) would be manually measured. For a properly calibrated brush assembly, the pattern should comprise an elongated area free of the test material approximately two and a half to three inches in width for the entire axial length of the drum-type brush. If measurement indicates that the pattern is too large or too small, thus indicating a non-optimum setting of the spacing of the brush from the work surface, the operator then would readjust the spacing and begin another iteration to properly set the spacing. This sequence may need to be repeated two or more times with the operator manually adjusting, testing and measuring to determine if the brush is properly adjusted. Because the ends of the bristles of the brush wear down during normal use over time this manual calibration sequence for adjusting the brush relative to the work surface is performed throughout the life of the brush.

A need thus exists in the art for a simple and reliable apparatus for use in accurately setting the spacing of a brush assembly relative to a work surface.

Furthermore, a need exists in the art for effective techniques and methods of fabricating and operating such an apparatus in conjunction with a wide variety of surface maintenance vehicles, including both propelled and walk-behind vehicles.

SUMMARY OF THE INVENTION

The present invention is an apparatus and method for optimizing performance of a drum-type brush so as to enhance cleaning performance of a work surface without deleteriously affecting the surface being cleaned while at the same time decreasing the amount of wear to the ends of the bristles of the brush.

In accordance with the present invention, a system used to set brush pattern and therefore the rate of wear of the bristles of the brush and resulting brush down pressure is provided. An operator observes the length of a worn edge portion of a work tool, such as the ends of bristles of a drum-type brush, to determine the then-present length of the worn edge portion. The operator may inspect the length through a window element disposed on a frame member that supports the work tool. The operator may measure the length directly with a ruler and the like or with reference to a first indicia present on or adjacent to a part of the worn edge portion of the work tool. The first indicia may comprise marks, bands, symbols, line segments, colored segments, letters, icons, numerals or the like. After the operator determines which one of the indicia corresponds to the then-present length of the worn edge portion a mechanical stop is set to which arrests an actuator for the raising and lowering the brush at a preferred working position. The preferred working position corresponds to the brush elevation at which the worn edge portion provides the desired optimum pattern. The preferred working position is indexed with a second indicia that correlates to the first indicia. Thus, when the manual actuator abuts the mechanical stop at the working position the worn edge portion of the work tool is retained at an optimum elevation.

An object of the present invention is to provide an adjustable height brush assembly for a surface maintenance vehicle that is rapidly adjusted and operated with an optimum range of spacing between the brush and the work surface.

Another object of the present invention is to provide an articulated work tool adjustment assembly for a surface maintenance vehicle which assembly is readily adjusted from a non-operating state to a preferred, calibrated operating state.

Another object is to maximize the useful adjustment travel of a manual actuator, disposed in a short-travel slot, for adjusting the elevation between a work tool and a work surface.

Another object of the present invention is to provide a class of manually adjustable mechanical coupling assemblies useable for adjusting an articulated brush assembly to a working position having a predetermined downforce that is generally the same for the bristles of said brush during the service life of the brush.

Another object of the present invention is to provide a method of fabricating, assembling and using the novel family of mechanical calibration couplings of the present invention.

Yet another object of the present invention is to provide a novel retrofitting apparatus and method of retrofitting prior art surface maintenance vehicles with the apparatus of the present invention so they may be used according to the methods of the present invention.

These and other objects, features and advantages will become apparent in light of the following detailed description of the preferred embodiments in connection with the drawings. Those skilled in the relevant art will readily appreciate that these drawings and embodiments are merely illustrative and not intended to limit the true spirit and scope of the invention disclosed, taught and enabled herein.

DETAILED DESCRIPTION OF THE ILLUSTRATED EMBODIMENTS

Figure 1:
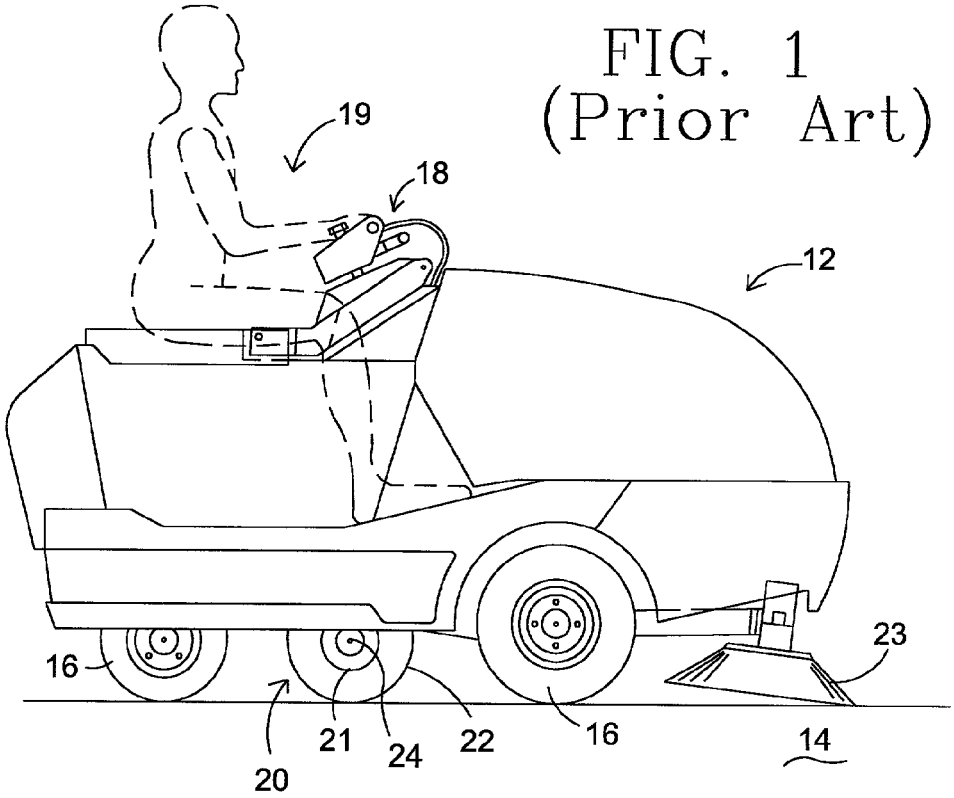
FIG. 1 (Prior Art)
FIG. 1 is an elevational side view of a surface maintenance vehicle having a pair of tools that each have a wearing working edge portion that performs work on a work surface.

The present invention will now be described for the benefit of the interested but perhaps uninitiated, without reference to the drawings or reference numerals recited therewith. After this description, a traditional detailed description of the illustrated embodiments is set forth. Neither description is to be used in limiting the present invention, as each are presented to better illuminate in a slightly different format, the patentable apparatus and methods of the present invention and some of the advantages flowing therefrom.

The present invention provides an apparatus and method for reliably adjusting a work tool coupled relative to a surface maintenance vehicle relative to a work surface. The present invention is particularly suited for such work tools having a working edge or periphery portion subject to wear (i.e., the "worn edge"). After inspecting the remaining length of the worn edge of the work tool an actuator is set to a preferred working position. The actuator is set so that the worn edge establishes a preferred pattern of contact with the work surface. A first indicia having markings which correspond to the remaining length of the worn edge is disposed on or adjacent the worn edge of the working tool. A second indicia, which corresponds to the first indicia, is placed adjacent the actuator so that the vehicle operator can readily set the actuator, and thus the worn edge, to the preferred working position. A mechanical stop member is preferably used to arrest the actuator at the proper setting. To begin surface maintenance with the worn edge, the operator simply moves the actuator until it engages the mechanical stop member; thus providing the preferred pattern of the worn edge on the work surface.

The first indicia may be applied to a transportable frame member that retains the work tool. The first indicia may comprise markings on a window element that covers a slot or opening in the transportable frame. In accordance with the present invention the first indicia needs to reveal the remaining length of the worn edge and may comprise markings applied to: a portable measuring stick or gauge, a portion of the worn edge, a telescoping member and the like. The worn edge may comprise bristles, tufts, fabric, closed or open cell foam materials, resilient wiper blades, scouring pads and the like which extend from a work tool core or base member.

The second indicia correlates to the first indicia and is preferably the same type or style as the first indicia to reduce possible error in setting the mechanical stop member to the appropriate position. The second indicia may be displayed on or near the actuator and/or the mechanical stop member. Thus, the actuator can be quickly and accurately positioned.

An optional mounting plate member having prefabricated mounting elements for the actuator and the mechanical stop may be used to simplify construction of the inventive apparatus. The mounting plate member preferably includes an elongated slot (which receives a middle portion of the actuator) and the adjustable mechanical stop member. The second indicia can be preprinted on the mounting plate. This optional plate member is mechanically coupled over an access port formed in or near an operator station or console of the surface maintenance vehicle.

As described and illustrated more fully elsewhere in this disclosure, the second indicia is calibrated relative to the first indicia to create a predefined pattern on the work surface thereby avoiding the guesswork and time wasting trial and error of prior art work tool calibration techniques. Calibration preferably takes place during assembly of the present invention and should be repeated after any of the operative components are repaired or replaced. Such calibration involves coupling the operative components together so that the spacing of a worn edge may be adjusted over a desired range of adjustment. The desired range of adjustment extends from an unsupported, or "free float," state to a fully supported, raised state wherein the worn edge does not contact the work surface. The first indicia should correspond to at least the serviceable length of the worn edge. The first indicia can be disposed temporarily or permanently on or near the worn edge so that the remaining length is readily revealed.

The second indicia preferably disposed adjacent an elongated slot in which the actuator moves to vary the spacing of the worn edge of a work tool relative to the work surface. The second indicia may, but does not need to, have a portion that relates to the position of the actuator when the work tool is in the unsupported free float state. The actuator is preferably an elongated lever mechanically coupled to a surface maintenance vehicle and adapted to provide adjustment of the spacing of the worn edge relative to the work surface.

In most embodiments of the present invention, the brush couples to an adjustable height frame structure which supports the work tool on its longitudinal axis of rotation. A source of rotational power is preferably coupled to the rotate the work tool. In contrast to the prior art, in most embodiments of the present invention, the work tool is raised and non-moving during measurement of the worn edge portion. Adjustment of mechanical stop member to set the pattern produced by the worn edge portion and the work surface also preferably occurs when the work tool is raised and non-moving. The mechanical stop member may comprise an L-shaped bracket, a bar, or other structure that arrests the movement of the actuator at a predetermined setting. The mechanical stop member may comprise one or more detents which are engaged by a preferably spring-biased actuator to help retain the actuator in a particular detent.

In those forms of the invention having a rotating drum-type brush, the first indicia comprises any suitable means of readily ascertaining the remaining length of the bristles. The first indicia may be temporarily or permanently disposed to reveal the remaining length of a majority of the bristles. For example, the first indicia may comprise individual marks, bands, symbols, line segments, icons, colored segments, letters, numerals or the like. Such indicia may be integrated into some or all of the bristles of the brush or may be disposed on the transportable frame for the work tool, on an elongated extension member, on a telescoping member or may comprise a portable member. The first indicia may be disposed near one or both lateral end portions of the brush. In one form of the invention, the first indicia may comprise concentric rings painted or otherwise applied to the bristles. Such concentric rings may be applied by spray painting over a stencil applied to one part of an end portion of the brush. Such a stencil may have apertures that are circular, semi- or partially-circular or which comprise line segments. The first indicia may be applied before or after a brush is mounted on a surface maintenance vehicle, or may be applied during or after the original fabrication of the brush.

A manual actuator coupled to a non-extensible member is adapted to change the spacing of the work tool relative to the work surface. The second indicia is preferably disposed in a location adjacent a slot that the manual actuator passes through so that an operator can readily confirm the setting of the manual actuator (and therefore the working elevation of the brush) at the preferred working position. However, as described and illustrated below, the second indicia may comprise markings on a wire, cable, chain or the like in which case the mechanical stop member may comprise an adjustable collar or fastener (coupled to the wire, cable or chain). The collar or fastener can be coupled where it interferes with motion of the wire, cable or chain and keeps the work tool suspended at a desired elevation relative to the work surface. Such a wire, cable or chain may be coupled to a rotary actuator, a pedal, a lever or a linear actuator and the like.

The weight of a work tool assembly, such as a drum-type brush/frame assembly, typically supplies an adequate amount of downforce to the work surface. However, a work tool may be biased using added weights, mechanical springs, gas springs, linear actuators and the like to so that the assembly floats (or, more accurately grinds) into the work surface. The present invention is preferably configured without added biasing mechanisms so that adjustment of the elevation of the work tool relative to the work surface is performed manually. In this way the spacing between the worn edge and the work surface is adjusted to maintain a desired, substantially constant pattern (and downforce) relative to the work surface.

The present invention provides benefit in the operation of any work tool having a wearing (or worn) edge portion which wears down over time and which is positionable toward and away from a work surface. In particular, for work tools having a worn edge which moves over a work surface during surface maintenance operations. Accordingly, a worn edge portion may rotate, translate, oscillate or vibrate with respect to the work surface.

The present invention is thus primarily directed to an apparatus and methods for optimizing the spacing between the worn edge of a work tool and a work surface so that a desired pattern is created on (and a desired downforce is applied to) the work surface.

One preferred aspect of the present invention is the configuration of a unique manual actuator. This manual actuator is an elongated manual lever sometimes referred to in this disclosure as a "sculptural handle." The sculptural handle is designed to optimize the amount of vertical spacing of the brush member when it is moved through a very limited range of useful travel (limited by a short-travel slot). One end portion of an enlarged foot portion of the sculptural handle preferably has a pivot location mechanically coupled to a structural member of the vehicle. The second end portion of the enlarged foot portion couples to a cable which in turn connects to the frame member. Thus, when an upwardly extending part of the sculptural handle is moved in the short-travel slot the enlarged foot portion pivots thus providing tension to the cable that supports the frame member (and the worn edge of the work tool) relative to the work surface. From the location where the upwardly extending portion of the sculptural handle meets the short-travel slot the sculptural handle it assumes a compound shape. This compound shape (in addition to the structures just recited) is designed to provide a maximum of vertical travel of the cable for a given short-travel slot. Of course, the foot portion and the upwardly extending portion of the sculptural handle may comprise separate components and may be coupled together via any conventional means (e.g., welding, solder, brazing or other bonding techniques or using mechanical means such as threaded nut and bolt combinations, screws, cotter and clevis pins and the like).

An assembly according to the present invention may also be raised, lowered, pivoted and/or rotated at an angle relative to the direction of motion of the surface maintenance vehicle. In addition, while the present invention is described and illustrated as passively employing gravity in conjunction with a relatively simple manual brush lifting mechanism using a cable and lever combination, suitable gearing providing a mechanical advantage, or powered lifting mechanisms and the like may also be utilized.

The present invention is also directed to methods of fabricating and operating the apparatus of the present invention, as more thoroughly described in this disclosure, especially for use in compact surface maintenance vehicles using only manual actuation.

In addition, the present invention may be applied to previously manufactured surface maintenance equipment and vehicles, in the form of retrofitted mechanical couplings and applied indicia. In one embodiment of this form of the present invention a first indicia is applied to a location on a frame member for the work tool (or on the work tool). The first indicia should be disposed in a location which provides for visible inspection of the first indicia in relation to the length of a then-present length of a worn edge of a work tool. Then, performing an initial calibration of a full range of linear travel, or displacement, of the work tool relative to a work surface when a tool spacing adjustment actuator is moved through its available range of adjustment. That is, assuming a direct linkage between the actuator position and the tool, determining an effective range of adjustment of the actuator to create a desired pattern, or contact patch, on the working surface—given the serviceable length of the worn edge. Then, applying a second indicia (related to the first indicia) near the actuator. Since the second indicia provides visual cues that relate the effective range of adjustment for the actuator to the size of the pattern, the second indicia should correspond to the full scope of the effective range.

Note that for certain work tools having a flexible or deformable worn edge portion, the relationship between the size of the pattern and the amount of travel of the actuator may be non-linear. For example, the pattern created by a drum-type brush varies due in part to the increasing resiliency of the bristles as they wear down. As a result, the first indicia preferably includes relatively finer gradations from a new worn edge portion toward an acceptable minimum amount of the worn edge portion. Accordingly, the first indicia may comprise discrete colored or numbered bands with such bands decreasing in size from a first band to a final band.

As described and illustrated herein, a substantially inextensible member, such as a cable, a wire or a chain couples to a member which transmits a tensioning force for changing the spacing of the worn edge relative to the work surface. A substantially inextensible member has the useful property of transmitting tension forces but not axial compression forces. Such a member can be used to lift and suspend the work tool at a desired spacing above a work surface and will deform if the worn edge encounters an oversized obstacle or a raised area of the work surface.

The brush assembly work tool of the present invention weighs approximately one hundred sixty pounds and is cantilevered from a fulcrum or pivot-coupling member connected to the vehicle. A single cable or multiple cables may be used to support the brush assembly although a single cable is preferred. Or, as those of skill in the art will recognize, various other structures may serve in lieu of a cable linking the manual actuator (e.g., essentially an elongated off-axis lever) to a work tool such as a drum-type brush. Such other structures may comprise a substantially inextensible wire, strap, chain, belt or the like. Such substantially inextensible structures may be used in lieu of (or in addition to) a cable. For example, two rods or plates of structural material such as metal, metallic-alloy, resin, plastic, composite, ceramic and the like may also be used. In the event such rods or plates are used in lieu of a cable, several linkages therebetween may be used which achieve the desired design objective. An example is a pair of plates slideably connected with conventional fasteners (as elsewhere described) or which otherwise interconnected similar to individual links in a chain. If plates are used at least one of the plates should have an elongated slot formed in an interior region thereof. Thus, if an axial compressive force is encountered the plates slide without transmitting the compressive force.

In the event that a given structural linkage is susceptible of being wound and unwound during adjustment, such as a wire, cable, strap or belt member, then the adjustable actuator may comprise a cam-actuated structure or a rotary structure coupled to a handle or handlebar. Of course, such an actuator may be manually actuated either by hand or using an oversize knob or lever and may include ratchet and pawl components to maintain a given setting.

In an alternate embodiment, the means of adjusting the spacing comprises a rotary handle over which the cable may be wound and unwound, thereby providing adjustment to the spacing between the brush and the work surface. This form of the invention may be implemented in a variety of ways, with mechanical advantage provided by suitable gearing or with a biasing force (e.g., using leaf, gas or coil springs and the like) which partly supports the brush assembly. In another alternate embodiment, a foot pedal assembly may be adapted to provide a raising force to the brush, as in a standard pedal configuration of a bicycle.

A lever having an enlarged foot portion is preferably used to adjust the length of the cable or other equivalent inextensible structure. A toe portion of the enlarged foot of the lever pivotably connects to the surface maintenance vehicle. The cable couples a heel portion of the enlarged foot so that when an operator moves the lever through its range of motion, the lever pivots and changes the elevation of structure coupled to the cable. Thus, the spacing between the toe and the foot part of the enlarged foot portion (i.e., spacing between the pivot and the cable coupled to the foot) creates mechanical advantage and provides the range of linear motion for the cable.

A few illustrated embodiments of the invention will now be described in detail with reference to the accompanying drawings in which like reference numerals refer to like elements throughout. While only depicted in drawings of prior art surface maintenance vehicles, the present invention is intended for use with all types of surface maintenance and surface conditioning vehicles. Such vehicles typically have a set of wheels, a steering mechanism, an operator station or console and a source of power coupled to a primary working tool. Since the present invention is directed to a unique adjustment and calibration linkage for a work tool, the variety of surface maintenance vehicles to which the invention is directed are not fully illustrated or described herein. For further description of illustration of such vehicles reference may be had to U.S. Pat. No. 6,003,186 and U.S. Pat. No. 6,202,243 which are incorporated herein by reference.

Referring now to FIG. 1 which is an elevational side view of a prior art surface maintenance vehicle 12 having a pair of work tools in the form of a drum-type brush 20 and front end disk-type brush 23. Each work tool has a worn edge portion in contact with a work surface 14 during surface maintenance operations. The vehicle 12 has an operator station or console 19, a steering mechanism 18, and tires 16 among other components. As is known and used in the art, a frame member (not shown) couples to end portions of a work tool such as drum-type brush 20. A core member 21 of the brush 20 having a plurality of bristles 22 coupled to the surface thereof and couples to the frame member at an axis of rotation 24 of the brush 20. The frame member is transportable with respect to the vehicle 12 so that the elevation of the ends of the bristles 22 (i.e., the worn edge portion) relative to the work surface 14 may be adjusted toward and away from the work surface 14.

Although the following exposition describes brush type surface maintenance or conditioning work tools having a brush for a surface-conditioning medium, other mediums are of course possible within the true spirit and scope of the present invention. Examples, among others, include cloth, burnishing pads, steel wool-like materials, and the like. The work tool may be in the form of a rotary drum-type or disk-type as illustrated in FIG. 1.

Figure 2:
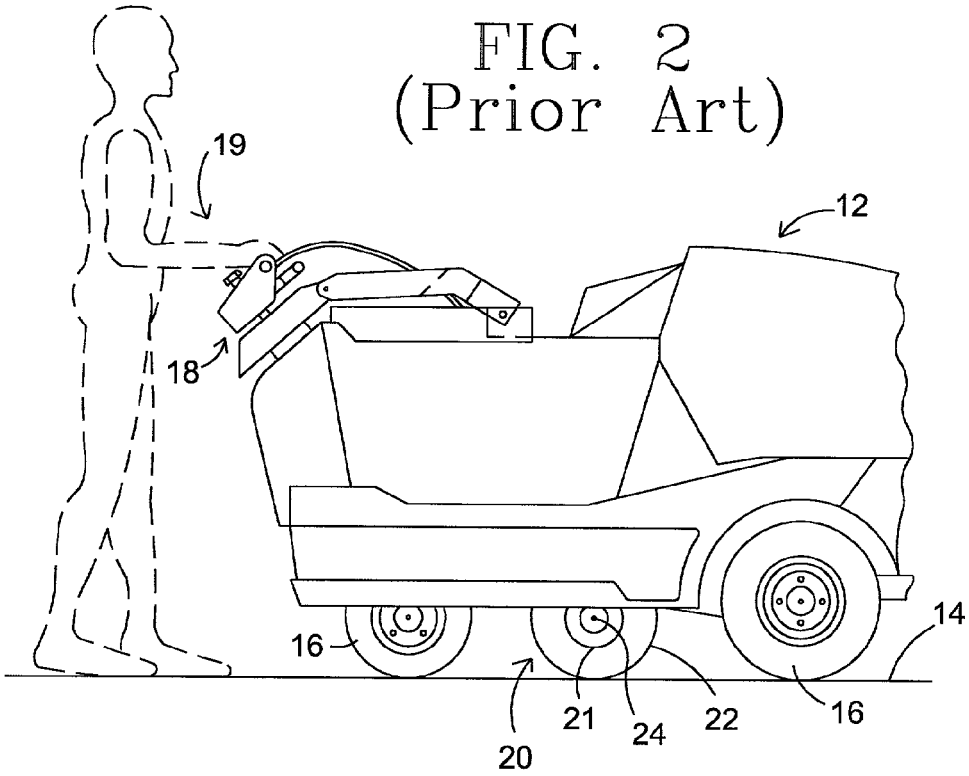
FIG. 2 (Prior Art)
FIG. 2 is an elevational side view of a surface maintenance vehicle having a tool that applies a wearing working edge portion to perform work on a work surface.

In FIG. 2 an elevational side view of another prior art surface maintenance vehicle 12 is depicted. The vehicle 12 is similar in most respects to the vehicle 12 depicted in FIG. 1, except that an operator of the vehicle 12 walks behind the vehicle 12. A powered work tool 20 having a worn edge portion 22 is coupled to a lower portion of the vehicle 12 so that the worn edge 22 can perform work on a work surface 14. While not depicted in FIG. 2, the vehicle 12 may be outfitted with additional components such as debris collection bins and dust removal systems.

Figure 3:
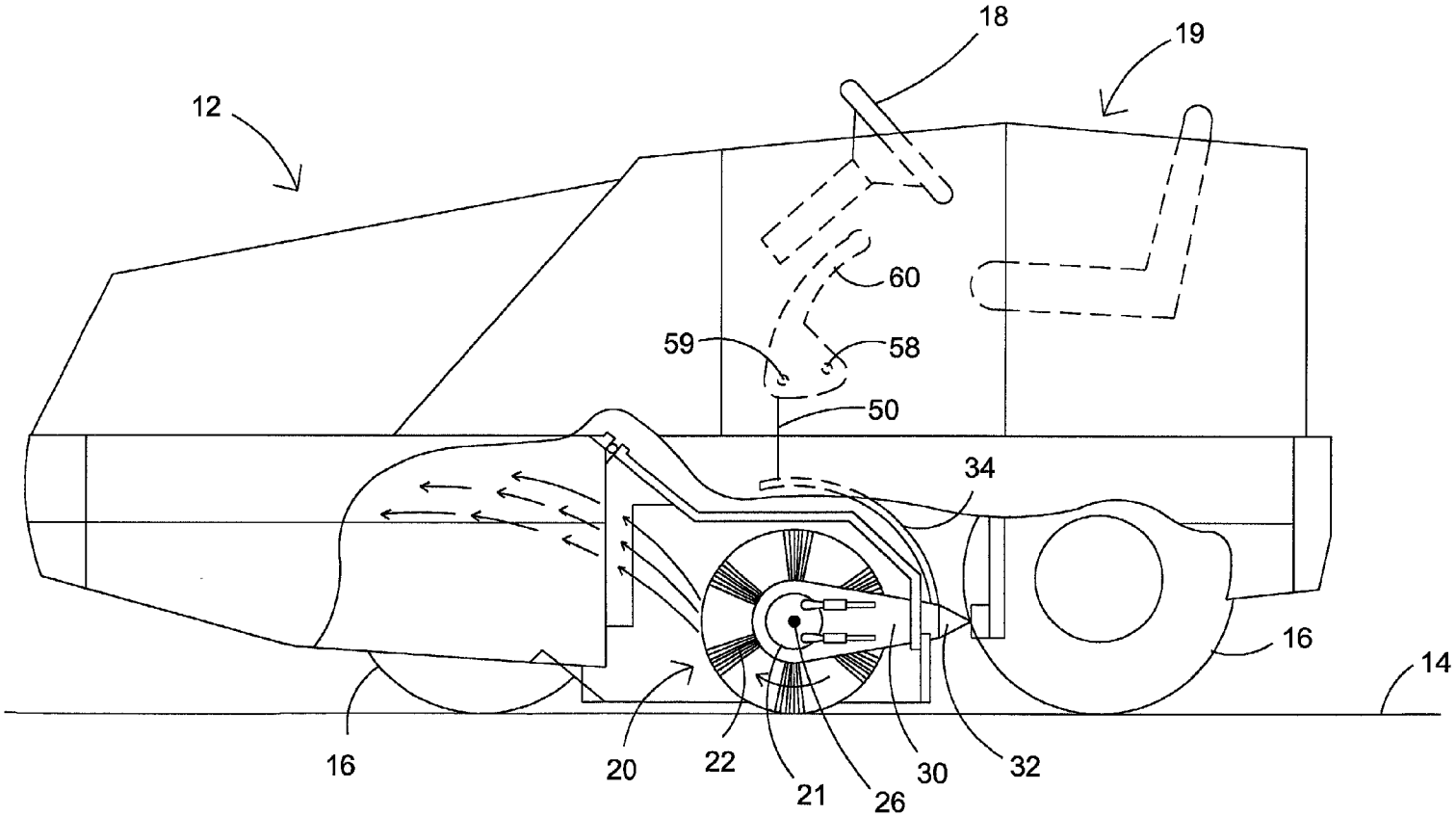
FIG. 3 is an elevational side view of a surface maintenance vehicle having a tool that applies a wearing working edge portion to perform work on a work surface with some of the components of the present invention shown in ghost.
Figure 4:
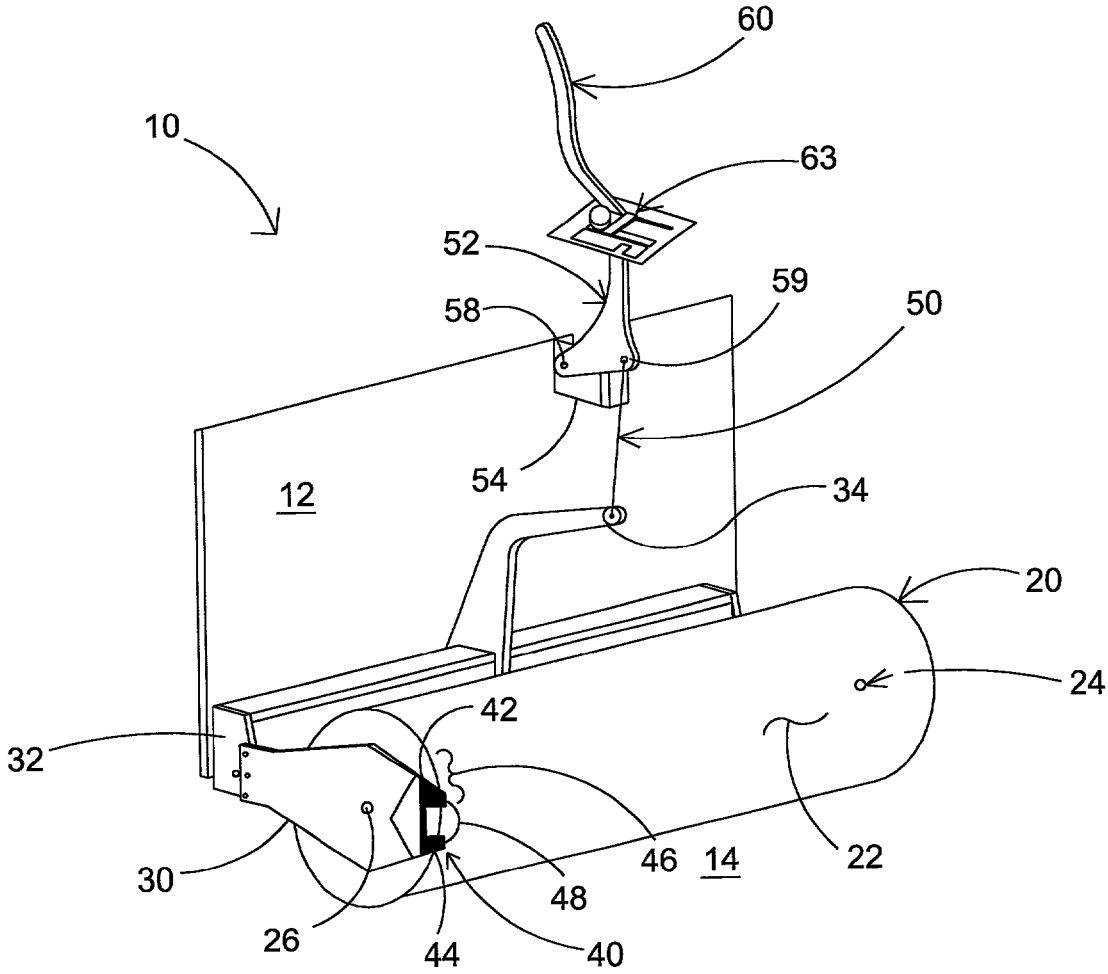
FIG. 4 is an exploded perspective view of the primary components of a mechanical coupling according to the present invention.

FIG. 3 is an elevational side view of a surface maintenance vehicle 12 having a work tool 20 with a worn edge portion 22 to perform work on a work surface 14 (with some of the components thereof shown in ghost). As illustrated in FIG. 3 the vehicle 12 has an operator station or console 19, a steering mechanism 18, and tires 16 among other components common to such a vehicle 12. A drum-type brush 20 having a core member 21 (shown in ghost) is coupled to the frame member 30 at an axis of rotation 26 of the brush 20. The frame member 30 is transportably coupled to the vehicle 12 via a pivot coupling 32 so that the elevation of the ends of the bristles 22 (i.e., the worn edge) may be adjusted toward and away from the work surface 14. An elongated member 34 couples to the frame member 30 from the same side as the pivot coupling 32 and extends above and preferably beyond the center of gravity of the brush assembly to increase leverage. The distal end of member 34 couples to a first end of a substantially inextensible member 50 (shown in ghost). As noted previously, the substantially inextensible member 50 may comprise a cable, a wire, a belt, a strap and the like. The other end of the member 50 couples to a manual actuator 60 (at mount 59). A fulcrum mount 58 spaced from the mount 59 pivotably couples to a portion of the vehicle 12 (at part 54—as depicted in FIG. 4). Thus, when an upper portion of the manual actuator 60 pivots (at mount 58) a tension force is conducted along the member 50 to increase the elevation of the frame 30, and thus the worn edge 22, relative to the work surface 14.

Referring now to FIG. 4 which is a perspective view of the primary components of one embodiment of a mechanical coupling 10 according to the present invention (in which a surface maintenance vehicle 12 is shown in block form). In FIG. 4, a drum-type brush 20 is retained at its opposing rotational axis mounts 24,26 to a frame member 30. The brush 20 preferably has tufts of bristles 22 disposed over at least a partial exterior surface of the brush 20 and the brush 20 is typically powered to rotate by a source of rotary power (not shown). Such a source of rotary power may comprise a rotary motor either directly coupled or coupled via suitable gearing (not shown). Such a rotary motor may comprise a dedicated unit or may derive power from one of the many forms and types of power that may be used as a source of power or propulsion for the vehicle. The source of power is coupled to a part of the brush 20 such as the core (not shown in FIG. 4) or rotational axis mounts 24,26 as is known and used in the art.

The brush 20 typically has a core (depicted in FIG. 12) comprising a hollow tube to which the bristles 22 are firmly affixed. The bristles 22 may form patterns and the like to promote removal of debris and litter from a work surface 14. A preferred type and size of brush 20 has a seven inch (7") diameter core and three and a half inch (3½") long bristles 22 for a total diameter (prior to first use) of fourteen inches (14"). The present invention promotes longer service life for such a brush 20 providing useful calibration and sweeping performance with decreasing bristle lengths; down to an approximately one inch (1") length. In this preferred embodiment the range of vertical adjustment with respect to the ends of the bristles 22 (i.e., the worn edge) of the brush 20 is thus approximately two and a half inches (2½") although more or less range may be obtained according to the present invention.

The frame member 30 is preferably comprised of several discrete metal components but the frame member 30 may be cast, molded (including so-called rotary molded) or formed as a single article. Preferably the frame 30 has a portion 40 adapted to allow for ready observation, comparison or measurement of the length of the worn edge portion (i.e., bristles 22). More preferably, the portion 40 comprises a first indicia 46 displayed adjacent a slot bound by two extending portions 42,44 of the frame member 30. As depicted in FIG. 4, a substantially transparent window element 48 may be coupled across the elongated slot and connected to the two extending portions 42,44. The first indicia 46 may be displayed on either portion 42,44, on the window element 48, on another portion of the frame 30, on the bristles 22, or on an independent, portable member (not shown) such as a measuring stick or the like.

Figure 5:
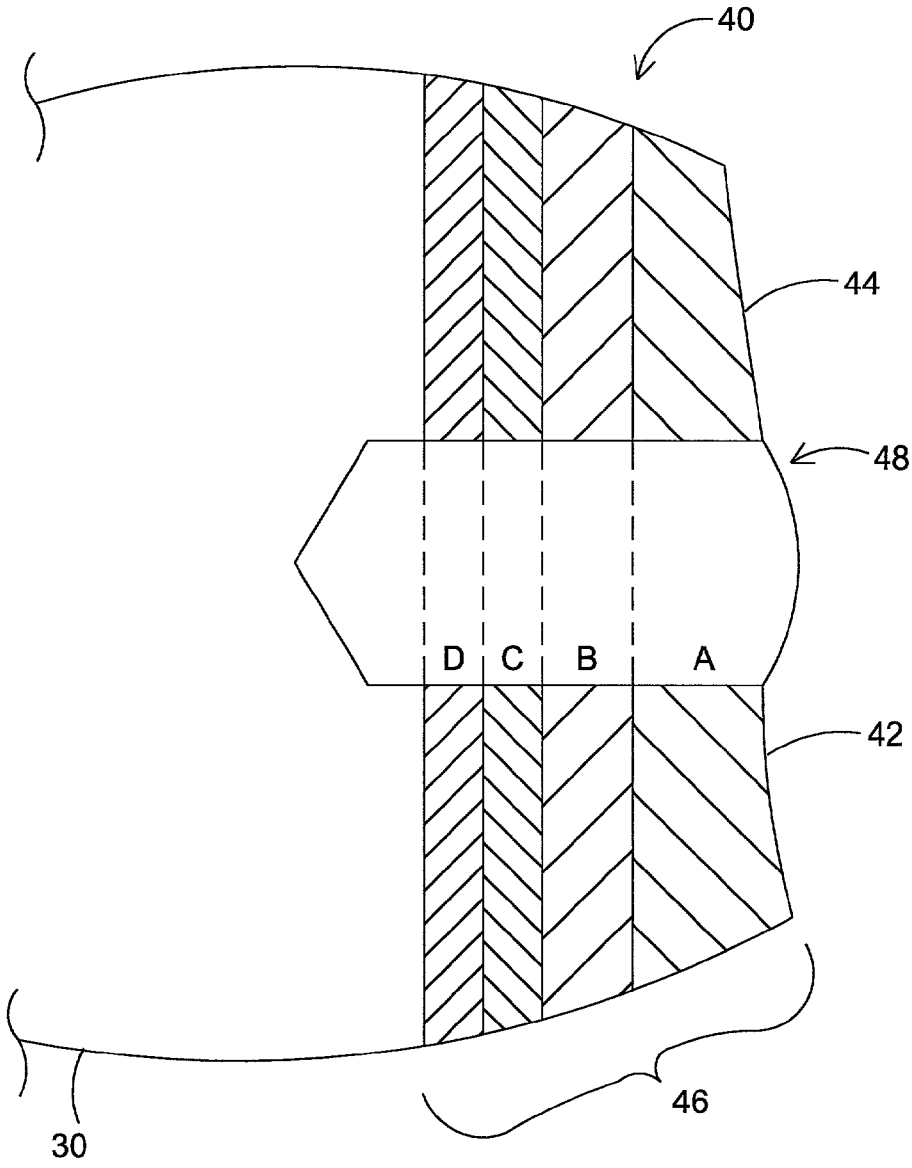
FIG. 5 is an elevational side view of a portion of the frame member illustrating one form of the first set of indicia according to the present invention.

As illustrated in FIG. 5, the first indicia 46 comprises four discrete zones (depicted as "A," "B," "C" and "D" in FIG. 5) which zones may be emblazoned with numeric, alphabetical, color-coded, and other characteristic indicia which is readily observable by the operator of the vehicle 12. For a worn edge 22 such as a plurality of bristles 22, the zones are preferably progressively smaller from a first zone toward a final zone. In this case, the final zone corresponds to the shortest bristles 22. This is largely due to the increasing stiffness of the bristles 22 as they become shorter during the service life of the bristles 22. It is believed that such progressively smaller zones more accurately correspond to the manner and degree that relatively longer bristles react to compression forces versus shorter bristles. That is, longer bristles may be spaced from a work surface over a slightly greater range relative to shorter bristles, with each maintaining a relatively consistent pattern on the work surface.

The frame member 30 for the brush 20 is mounted to vehicle 12 with a pivoting (i.e., angular) or a sliding (i.e., linear) coupling member 32 or members to render the frame member 30 transportable relative to the vehicle 12. In a preferred embodiment of the present invention, a first end of the substantially inextensible member 50 (e.g., a cable, filament, wire, cord or the like) couples to the arm 34 which couples to the frame member 30. The second end of the member 50 couples to a manual actuator 60 (the elongated lever member in FIG. 4) as depicted in FIG. 4 (and as elsewhere described herein).

In the case of a pivoting coupling 32, the location of the coupling member 32 may be either at the rear or the front of the frame member 30 to pivotably couple the frame 30 to the vehicle 12. As noted and depicted, if the coupling member 32 is a pivoting member, an elongated lifting arm 34 is preferably coupled to a location on the frame member 30 near the pivoting member which extends beyond a vertical axis including the center of gravity of the brush assembly. In this way a greater mechanical advantage is obtained which reduces the force (transmitted along the cable 50) required to pivot the frame member 30 to increase the spacing of the worn edge 22 of the brush 20 relative to the work surface 14.

If the coupling member 32 provides for linear motion of the frame 30, one or more idler pulleys configured to increase the purchase of the cable 50 may be used. Thus, some mechanical advantage is obtained which reduces the force required to move (i.e., lift) the frame member 30 to increase the spacing of the worn edge 22 relative to the work surface 14. Of course, more than one cable 50 may be used, or a single cable 50 having multiple connecting locations may be used to uniformly raise and lower the brush 20.

With continuing reference to FIG. 4, an enlarged foot portion 52 (as depicted portion 52 is integral to the lever 60) has a toe portion pivotally coupled at mount 58 to a structural part 54 (of the vehicle 12). The heel of the foot portion 52 is connected to the cable 50 so that when the manual actuator 60 is moved the elevation of the worn edge 22 relative to a work surface 14 changes.

As noted in the Background section of this disclosure, in the prior art a pattern of testing materials removed by the brush was used to calibrate the brush assembly. The present invention requires merely that the location or zone where the ends of the bristles 22 (i.e., the worn edge) are located correspond to a one of the first indicia 46. A mechanical stop 63 is then set to prevent the actuator 60 from lowering the worn edge 22 beyond the location that provides a desired size pattern of the worn edge 22 upon the work surface 14. The adjustment technique of the present invention is performed with the brush 20 in an upright, or raised position with the work tool 20 in a stationary, non-rotating, state.

Referring now to FIG. 5, which is an elevational view of one form of the portion 40 showing one type of first indicia 46 (hatch marks) displayed on opposing sides 42,44 of a notch or cut-out from the frame 30. A window element 48 bridges the notch or cut-out to provide a frame of reference for comparing the first indicia 46 to the terminal ends of the bristles 22. As illustrated, the window element 48 has another type of first indicia formed on the window 48 (i.e., letters "A," "B," "C," and "D"). As noted above, a one of the first indicia 46 (corresponding to the maximum length of the worn edge) farthest from the core 21 is preferably the widest of the indicia 46. Each successive indicia 46 is progressively smaller than its preceding adjacent neighbor. This is especially true when pivot-type couplings 32 are used to connect the frame member 30 to the vehicle 12. This is due primarily to the size and geometry (and diminishing diameter) of the brush 20 and takes into consideration the decreasing amount that the bristles 22 bend as they wear down (to provide a desired pattern).

Figure 6:
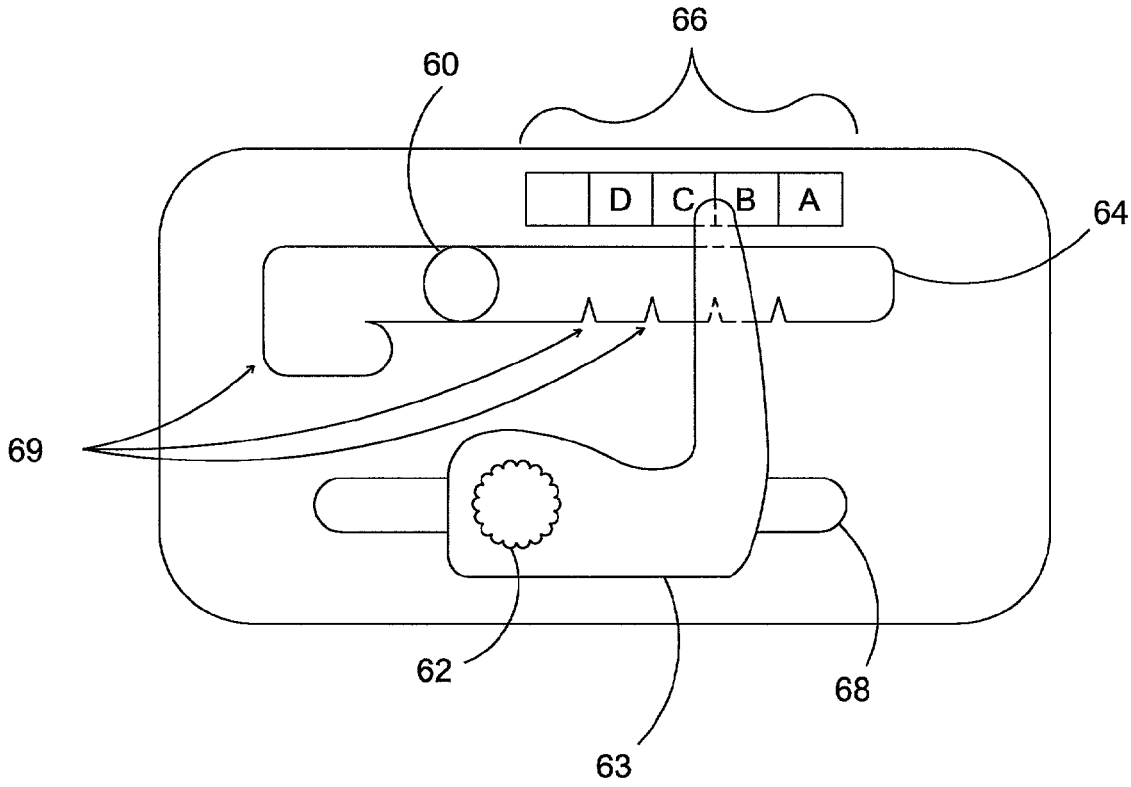
FIG. 6 is a plan view of an operator control for a manual actuator according to the present invention.

FIG. 6 is a plan view of the manual actuator 60 passing through an elongated slot 64 both of which are disposed in or near an operator console or station (denoted by reference numeral 19 in FIG. 1 and FIG. 2). The lever 60 has a middle portion disposed in the elongated slot 64. At one end of the elongated slot 64 a detent 69 for receiving the middle portion of the lever 60 is shown (when lever 60 is placed in the detent 60 the brush 20 is in a fully raised state). An adjustable mechanical stop assembly 62,63 is adapted to restrict the lever 60 to a smaller range of adjustment than the full length of the elongated slot 64. A second indicia 66 (which is preferably similar or related to the first indicia 46) is displayed adjacent the elongated slot 64. Thus, after observing or measuring the relative length of the bristles 22 of the brush 20 in comparison to the first indicia 46, the operator adjusts the mechanical stop member 62 so that a portion of the member 63 limits the travel of the lever 60. The location of the member 63 relates to the location corresponding to a one of the second indicia 66. As noted, the one of the second indicia 66 relates to a one of the first indicia 46 which most closely represents the then-present length of the worn edge 22 (i.e., bristles in the illustrated embodiments).

In an alternate form of this embodiment, a series of features similar in function to detent 69 (e.g., a notch, a slot or a series of sawtooth features and the like) may be formed in sides of the elongated slot 64. The lever 60 may be spring biased so that the operator must affirmatively deselect a one of the settings for the lever 60 relative to the second indicia 66. Regardless of the type of mechanical stop employed, the slot 64 preferably has at least this one detent 69 formed near the end of the slot 64 to safely retain the lever 60 when the work tool 20 is fully raised.

The components of the present invention may be fabricated from materials including without limitation, metal, metallic-alloy, composite, fiber-reinforced, ceramic, wood, resin, plastic, glass and the like. The methods of adjusting the spacing of the worn edge 22 relative to a work surface 14 may be conducted whether the work tool 20 is powered, unpowered, and whether the vehicle 12 is moving or static. While not depicted in the drawings, an optional intermittent source of illumination (e.g., a stroboscopic light) or a continuous source of illumination may be provided to ease visual inspection of the worn edge 22. Also, a corresponding subset of indicia may be added to the first and/or second indicia 46,66 which correspond to a relatively greater or lesser pattern size. Thus, the operator may temporarily increase the size of the pattern, if desired, or simply allow the brush to "free float" with the full weight of the work tool assembly providing a maximum of downforce to the work surface 14.

Figure 7:
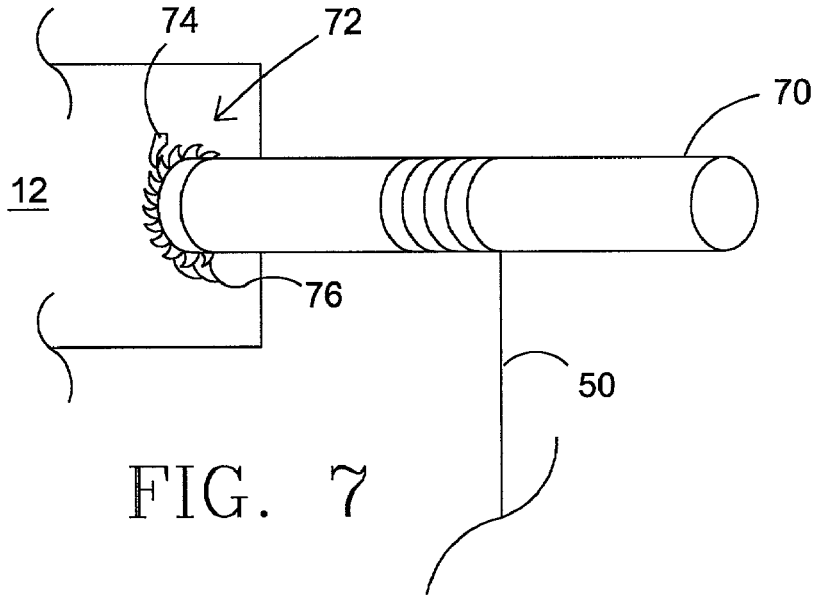
FIG. 7 is a perspective view of an alternate embodiment of a manual actuator that may be utilized in practicing the present invention.

In another embodiment of the present invention depicted in a perspective view in FIG. 7, the lever 60 is replaced with a substantially cylindrical handle member 70 mounted in any convenient manually accessible location of vehicle 12. The handle member 70 may be adapted to receive a bar or lever (not shown) to increase mechanical advantage. A ratchet-type apparatus 72 may be used to support the cable, and thus the working edge portion 22 at a desired elevation with respect to work surface 14. Such an apparatus 72 may have a pawl 74 which can be set to engage one of a series of teeth 76 disposed on a wheel member 78 (which may be a separate component or may comprise a part of the handle 70).

In this and other embodiments, in lieu of or in addition to the first indicia 46 at least some of the bristles 22 may be color coded (or otherwise marked) to indicate the remaining length thereof. Thus, the first indicia 46 may be optionally displayed on the frame member 30 to provide a visual reconfirmation, but said first set of indicia 46 could comprise just a series of hatch marks indicating the useful range of lengths of such color coded bristles 22. That is, in this embodiment the first set of indicia 46 does not need to be displayed on the frame member 30 or window element 48 at all. Likewise, the second set of indicia 66 may comprise a color-coded portion of the cable 50, which is wound around a portion of the handle member 70 until a coordinating color-coded part of the cable 50 reaches a corresponding part of the handle member 70.

Figure 8:
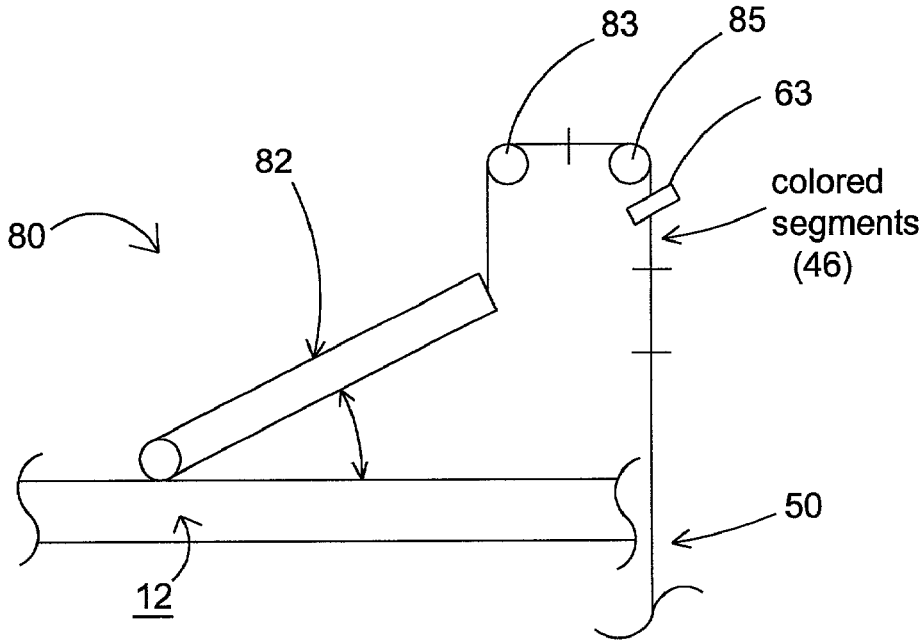
FIG. 8 is an elevational side view of another alternate embodiment of a manual actuator that may be utilized in practicing the present invention.

In another alternate embodiment of the present invention depicted in FIG. 8, a pedal assembly 80 is coupled to a support surface of the vehicle 12. To increase mechanical advantage, a pair of idler pulleys 83,85 are coupled to the cable 50. The cable 50 has alternating bands of indicia 46 displayed on the surface of the cable 50 so the operator can determine, or infer the present spacing of the brush 20 relative to the work surface 14. While not depicted in FIG. 8, a window element 48 may be disposed above or adjacent the idler pulleys 83,85 so that an operator may view the segment of cable 50 disposed therebetween. In this embodiment, the mechanical stop member 63 may comprise a block, clamp or the like which is coupled to the cable 50 and interferes with the progress of the cable at one of the idler pulleys 83,85 or at a different location such as a guide loop and the like (not shown) thus providing the advantages of the mechanical stop as described elsewhere in this disclosure.

In a non-illustrated but related form of the alternate embodiment just discussed, the pedal assembly resembles a set of pedals for a bicycle and the operator simply raises or lowers the brush by rotating the pedal member which is coupled to the substantially inextensible structure. An optional mechanical stop may be implemented in this form of the present invention such as a block, clamp or the like which is coupled to the cable and interferes with the progress of the cable. Referring again to FIG. 8, such a stop may be disposed at one of the idler pulleys 83,85 or at a different location such as a guide loop and the like.

Figure 9A:
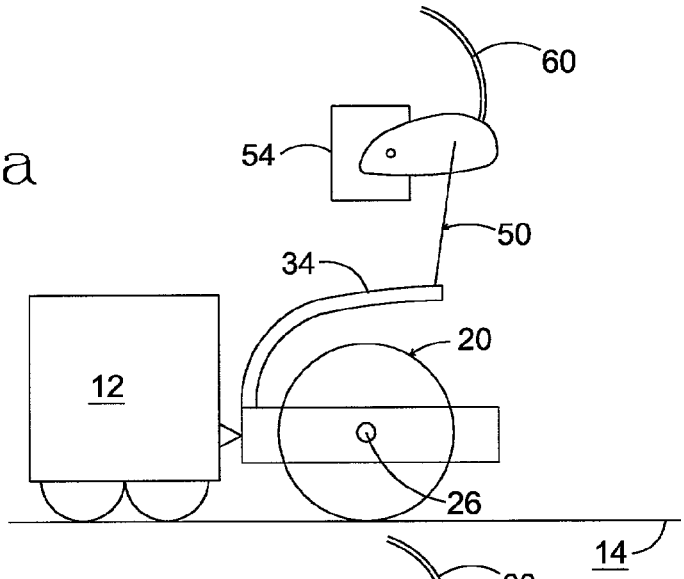
FIGS. 9*a* through FIG. 9*c* are elevational side views of the operative elements of the present invention in three different states; namely, a normal operating state, a raised state and a obstacle-encountering state, respectively.
Figure 9B:
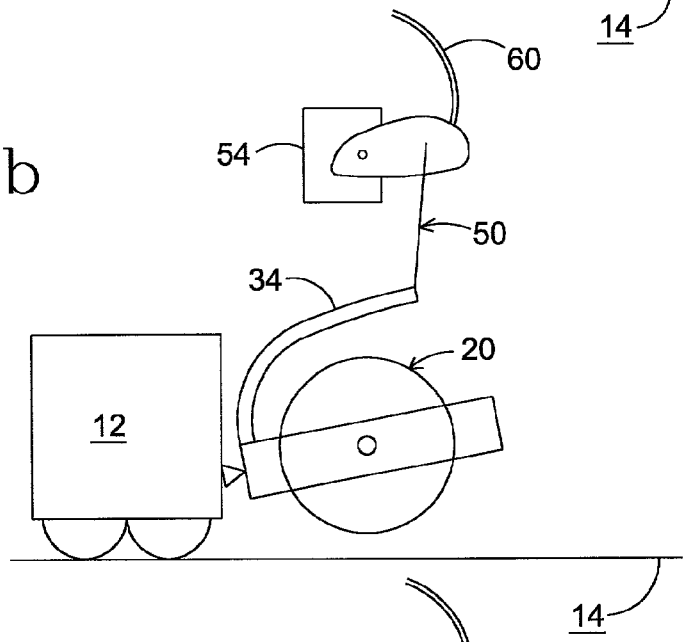
Figure 9C:
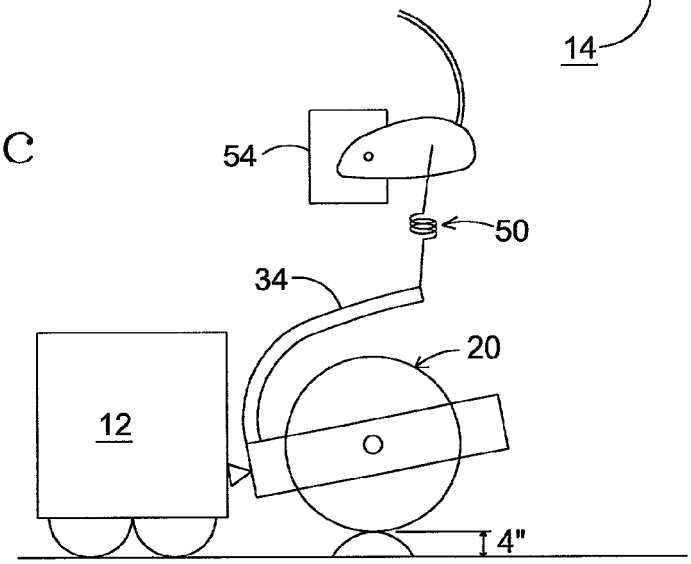

An illustration of three operational states of the brush assembly of the present invention are depicted in FIGS. 9*a*, 9*b* and 9*c*. In FIG. 9*a*, the worn edge 22 of the brush 20 is depicted in a typical operational state wherein the worn edge 22 establishes contact with the work surface 14. In FIG. 9*b*, the worn edge 22 is shown spaced from the work surface 14. In FIG. 9*c*, an illustration of the impact of a four inch obstacle impacts the worn edge 22 thus causing the worn edge 22 to rise and releasing the tension in the inextensible cable member 50. Note that the scenario depicted in FIG. 9*c* will result if the worn edge portion 22 impacts an obstacle regardless whether or not the lever 60 (and thus the work tool 20) is fully raised or lowered into position to perform surface maintenance and cleaning operations.

Figure 10A:
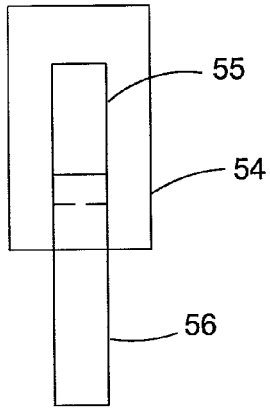
FIG. 10 is a plan view of an alternate embodiment for a tension-force conducting member (which does not appreciably conduct compression force) that may be utilized in practicing the present invention.
Figure 10B:
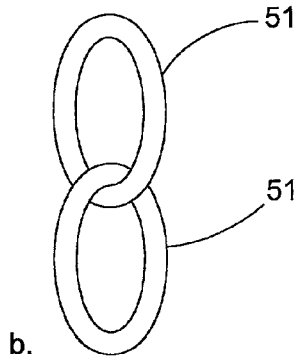

An alternate form of the substantially inextensible cable 50 is depicted in FIG. 10*a* and FIG. 10*b*. In these forms of the present invention, the substantially inextensible structure may comprise any material or combination of materials or units that can withstand the tension forces imparted during operation and that do not transmit substantially any axial compression forces. For example, two rods or plates 54,56 of a structural material such as metal, metallic-alloy, resin, plastic, composite, ceramic and the like may be used in forming the member 50. In the event that such rods or plates 54,56 are used in lieu of a cable, several linkages therebetween may be used which achieve the desired design objective. An example is a pair of plates 54,56 which are either slideably connected with conventional fasteners (e.g., threaded shank and nut combination, cotter and clevis pins, rivets, and the like). A plurality of members 51 similar to the members depicted in FIG. 10*b* may be employed in lieu of cable 50 or plates 54,56 to connect similar to links in a chain (a viable alternate for the cable 50). The members 51 readily transmit axial tension forces and do not transmit compression forces. Note in this regard that if the plates 52,54 are used at least one of the plates should have an elongated slot 55 formed in an interior region thereof. Thus, if an axial compressive force is encountered the plates slide together without displacing the lever 60, any mounting or intermediate components thereof.

Figure 11:
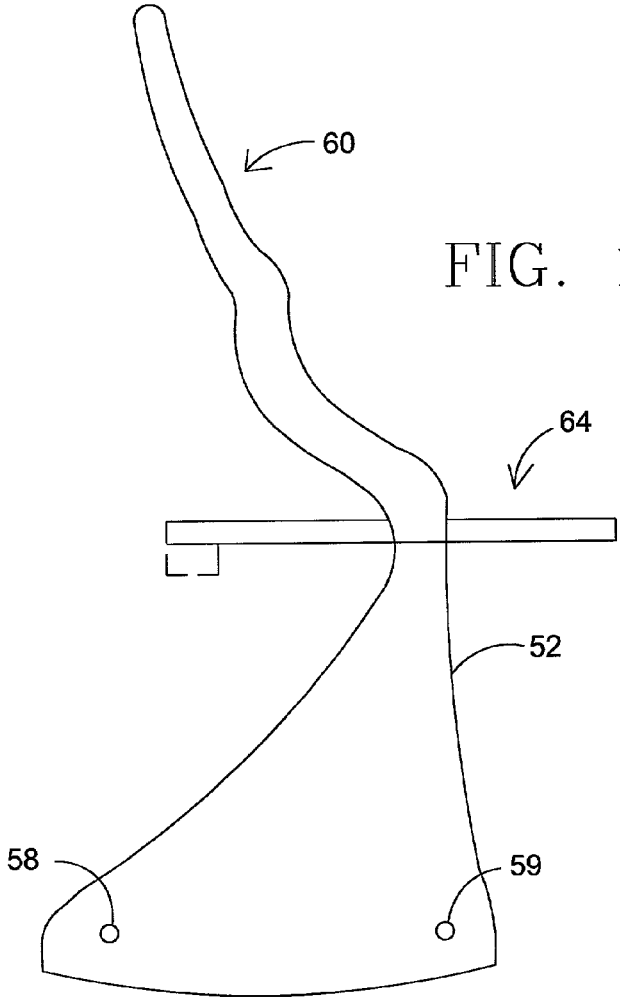
FIG. 11 is an elevational side view of a preferred manual actuator of the present invention (with an elongated slot shown in ghost), which is referred to in this disclosure as a sculptural handle, which may be utilized in practicing the present invention.

Referring now to FIG. 11 a so-called sculptural handle 60 is depicted that optimizes the amount of vertical spacing of the worn edge 22 when the handle 60 is moved across the short-travel slot 64 (shown in ghost). A toe portion of an enlarged foot 52 of the sculptural handle 60 has a fulcrum, or pivot mount 58, mechanically coupled to a structural member (denoted by reference numeral 54 in FIG. 4) of the vehicle 12. A heel portion of the enlarged foot has a second mount 59 to which the cable 50 is coupled. The other end of cable 50 preferably connects to an end portion of the pivot arm 34 which is coupled to the frame member 30 (See FIG. 4). The upwardly extending part of the sculptural handle 60 also couples near the heel portion of the enlarged foot 52 to enhance the mechanical advantage when the handle 60 moves toward the detent 69 (i.e., the fully raised position of the brush 20—See FIG. 6). From the location where the upwardly extending portion of the handle 60 meets the short-travel slot 64 the sculptural handle 60 assumes a compound shape. This compound shape (in addition to the structures just recited) provides for a maximum of vertical travel of the cable 50 given the length of the short-travel slot 64, for a single integrated lever component. Of course, the enlarged foot portion 52 and the upwardly extending portion of the sculptural handle 60 may comprise separate components and may be coupled together via any conventional means (e.g., welding, solder, brazing or other bonding techniques or using mechanical means such as threaded nut and bolt combinations, screws, cotter and clevis pins and the like). In a preferred form of the present invention the enlarged foot portion 52 is a substantially planar portion formed of structural steel. The upper portion of the lever 60 has a complex cylindrical shape disposed at a obtuse angle relative to the enlarged foot portion 52.

Figure 12:
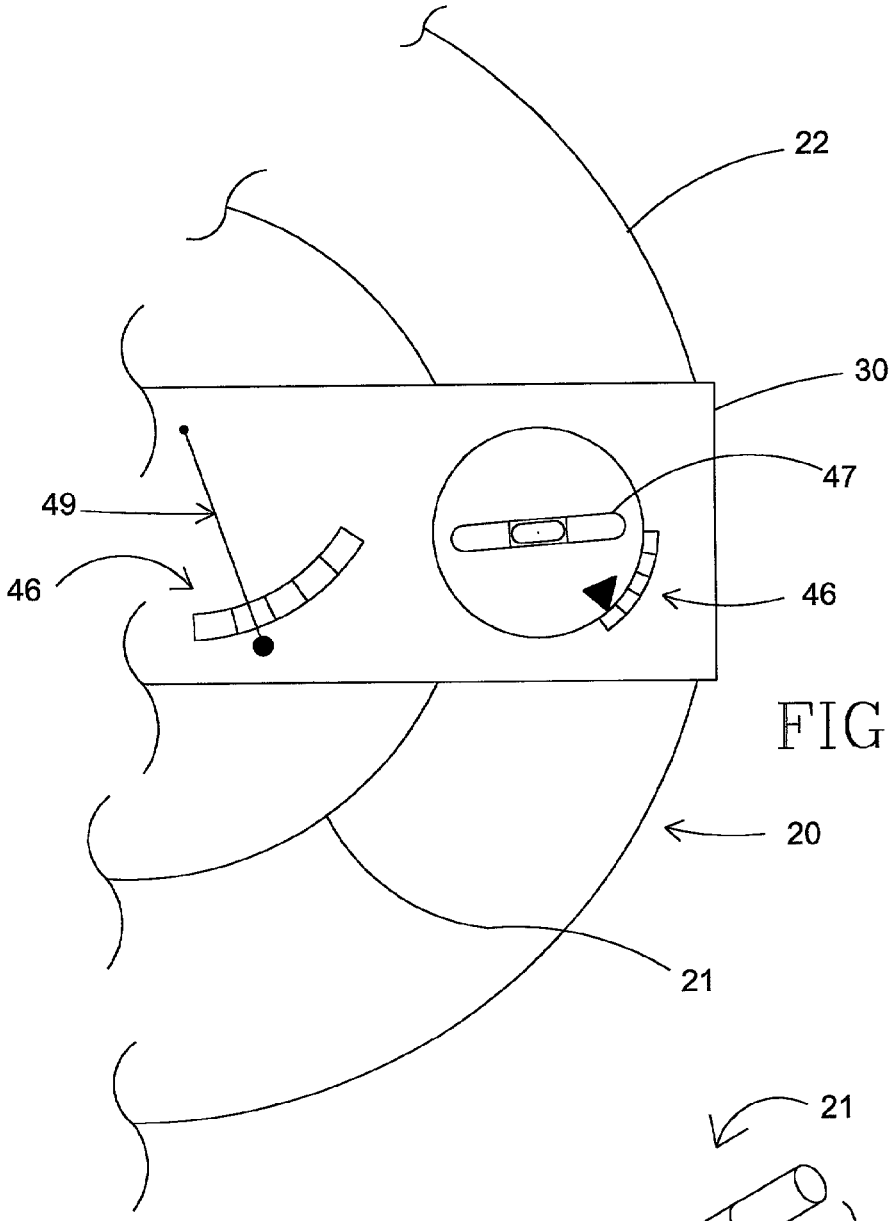
FIG. 12 is an elevational side view of an alternate embodiment of the present invention which may be utilized when practicing an alternate form of the present invention wherein a an angle of a pivot-coupled frame member relative to the work surface is determined as an indirect method of determining the length of the bristles of the brush.

Note that the first indicia 46 may be applied to or displayed by a portable remote unit (e.g., a ruler, measuring stick or other calibrated member), may be inscribed on the frame 40 or on a telescoping, folding or extendible portion thereof and the like. In addition, an extendable spar member or a spring-loaded tape wound inside a compact, dirt and dust resistant dispenser may also be used in practicing this aspect of the present invention. In addition, for those embodiments of the present invention having a frame member 30 coupled to the vehicle 12 with a pivot-type mechanical coupling 32, in lieu of the forms of indicia 46 taught or described herein, other apparatus and methods of determining the remaining length of the worn edge 22 may be used. In one such form of this embodiment (and as depicted in FIG. 12), an operator simply measures or observes the angle of the frame 30 relative to a work surface 14 when a non-rotating brush 20 is resting either in a fully or partially supported configuration on the work surface 14. The measurement or observation may be qualitative or quantitative (i.e., a range or an exact number of degree values corresponding to said angle). The inventor acknowledges that this embodiment will likely not render as precise a correlation between the diameter of the work tool 20 and the appropriate setting of an actuator 60. For drum-type brushes, this lack of precise correlation is believed to be due to, among other things, the length and rigidity of various types of the bristles 22 which may differ (i.e., when the brush 20 rests on the work surface 14 it may deform the bristles 22 more or less depending on several factors). A suggested technique for minimizing these various factors involves the step of performing this calibration sequence with the brush 20 in the same rotational position. In this way the brush 20 should rest more consistently and thus provide for a more consistent, and better—albeit not best, calibration.

In this form of the invention, the second indicia 66 need only display either several possible ranges or exact numerical degree values in order for the operator to rapidly and accurately adjust the operational elevation of the work tool 20. In this form of the invention, a bubble-type level 47 may be temporarily or permanently coupled to the frame member 30 to aid the measurement or observation of the angle between the frame member 30 and the work surface 14. If one assumes that the work surface 14 is substantially flat and horizontal and the vehicle 12 is not inclined, then a bubble-type level 47 is not required and the first set of indicia 46 need only comprehend the angle of the frame member 30 with respect to a reference line (assumed horizontal) displayed on a portion of the vehicle 12 adjacent the frame member 40.

As depicted in FIG. 12, a rotary dial incorporating a bubble-type level 47 and having a first set of radial indicia 46 disposed around at least a portion of the circumference of the rotary dial may be disposed on a portion of the frame member 40 so that the operator may rotate the dial to center the bubble and then note or record the relative position of the dial to the first set of indicia 46.

Also depicted in FIG. 12 is a pendulum assembly 49 which comprises a pendulum bob unit attached to a string, wire, fiber or the like and disposed adjacent the pendulum assembly 49 is the first indicia 46. The pendulum assembly 49 may be used alone or in conjunction with the bubble-type level 47 to indicate the relative orientation of the brush, as described above, to fairly accurately adjust the elevation of the brush 20 with respect to a work surface 14. If desired, the pendulum assembly 49 can be removeably coupled to the frame 30.

Figure 13:
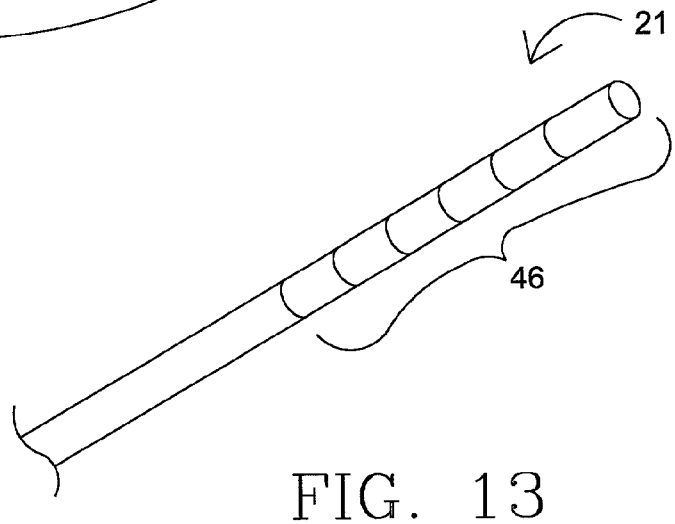
FIG. 13 is a perspective view of a single bristle having a first set of indicia incorporated into the terminal end of such bristle, which may be utilized in practicing the present invention.

Of course, in all the embodiments of the present invention the first indicia may be displayed in a difficult to reach location, covered by other components, of simply difficult to view. In these cases suitable access panels or ports, sources of illumination, mirrors or other reflecting surfaces may be used to ease manual access and/or observation of the first set of indicia 46. With respect to those embodiments wherein bristles 22 that are color-coded to indicate length (as depicted in FIG. 13) may require application of solvent, detergent, and the like which may be manually applied prior to or during calibration procedures or may be dispensed automatically either as an additional fluid or in the form of known cleaning solutions now used in the regular course of scrubbing and brushing a work surface 14 using a surface maintenance vehicle 12.

Additional advantages and modifications of the present invention will readily occur to those skilled in the art. The present invention in its broader aspects is, therefore, not limited to the specific details, representative apparatus and illustrative examples shown and described. Accordingly, departures from such details may be made without departing from the true spirit and scope of the applicant's general inventive concept and are intended to be covered hereby.

It should be recognized by those skilled the art, the present invention is applicable to any type of work tool having a surface conditioning medium having a wearable worn edge portion—that is, having an effective length indicating remaining life of the medium, all of which are intended to be within the true spirit and scope of the present invention.

Further, the indicia associated with the work tool or work tool assembly for visually determining the worn edge portion or effective remaining length of the work tool or medium, and the measurement or correlation indicia associated with the actuator, particularly the manually operated actuator, for setting the height of the work tool relative to the work surface, may of course be positioned or located in accordance with a wide range of choices and may take on many forms, as should be appreciated by those skilled in the art.

Lastly, although the present invention has been described by way of visually inspecting the worn edge portion relative to a first indicia, and then manually setting the height of the work tool in accordance with a second indicia, the processed may be automated, as such and is intended to be within the true spirit and scope of the present invention.

I claim:

1. An apparatus associated with a surface maintenance machine, including a machine frame, for maintaining a selected pattern of a work tool upon a work surface, wherein the work tool includes a medium exhibiting an effective working length that determines the selected pattern of the work tool upon the work surface when selectively engaged with the work surface, the apparatus comprising:

a transportable frame assembly, including a transportable frame member, mechanically coupled to the machine frame for supporting the work tool;

a settable actuator for selectively positioning said transportable frame member relative to said work surface for selectively engaging the work tool with the work surface;

first indicia having graduated markings and disposed in a location proximate said work tool so as to provide an indication of the current effective working length of the work tool medium; and second indicia, disposed in a location proximate said settable actuator, said second indicia having graduated marking corresponding to said graduated markings of said first indicia so that the actuator is settable to achieve a selected pattern of the work tool upon the work surface when engaged with the work surface in relation to said indication of the current effective working length of the work tool medium.

2. The apparatus according to claim 1, further comprising a manually adjustable mechanical stop member mechanism settable to arrest the actuator at a selected position relative to said second indicia so that the medium of the work tool achieves the selected pattern of the work tool upon the work surface when engaged therewith.

3. An apparatus according to claim 2, wherein the settable actuator includes (i) an elongated lever member and (ii) an end member, wherein said end member includes first and second spaced apart attachment mechanisms, and where said first attachment mechanism is pivotally coupled to the machine frame, and the second attachment mechanism is coupled to the transportable frame assembly.

4. An apparatus according to claim 3, said machine frame further includes a slotted frame member including a slot, and wherein the elongated lever has a a portion thereof disposed through the slot.

5. An apparatus according to claim 1, wherein the first indicia includes at least two graduated markings disposed on the transportable frame member, the work tool medium or both the transportable frame member and the work tool medium.

6. An apparatus according to claim 1, wherein the transportable frame member further includes at least a one of the following: (i) an aperture, and where the first indicia is disposed on said transportable frame member and proximate said aperture; (ii) a telescoping member coupled to the transportable frame member and said telescoping member having the first indicia disposed on a surface thereof; (iii) a folding member coupled to the transportable frame member and having the first indicia disposed on a part of the folding member; a portable member removeably coupled to the transportable frame member and having the first indicia disposed on a surface thereof; (iv) a pendulum assembly including a bob unit coupled to the transportable frame member in proximity to the first indicia; or (v) a bubble-type level instrument coupled to the transportable frame member and having the first indicia displayed adjacent the bubble-type level.

7. An apparatus according to claim 1, wherein the first indicia and the second indicia are of different size of the same type of indicia.

8. An apparatus according to claim 4, wherein:

said work tool is a drum-type brush having medium that extends radially from a central longitudinal axis thereof;

the transportable frame assembly is pivotably coupled to the machine frame about an axis in parallel with said central longitudinal axis of said drum-type brush, and wherein said apparatus further includes a structural member coupled at a first end thereof to the transportable frame assembly and coupled at a second end thereof to the second attachment mechanism of said settable actuator end member.

9. An improvement to a surface maintenance machine having a lever-actuated work tool assembly coupled to a machine frame member thereof, for maintaining a selected pattern of a work tool upon a work surface, wherein the work tool includes a medium exhibiting an effective working length that determines the selected pattern of the work tool upon the work surface when selectively engaged with the work surface, the improvement comprising:

measurement indicia having graduated markings and disposed in a location proximate said work tool so as to provide a measurement indication of the current effective working length of the work tool medium; and a settable actuator coupled to said work tool assembly operable to raise and lower the work tool relative to the work surface in relation to said measurement indication of the current effective working length of the work tool medium;

correlation indicia disposed in a location proximate said settable actuator, said second indicia having graduated marking corresponding to said graduated markings of said measurement indicia so that the settable actuator is settable to achieve a selected pattern of the work tool upon the work surface when engaged with the work surface in relation to said indication of the current effective working length of the work tool medium; and a manually adjustable mechanical stop member mechanism settable to arrest the actuator at a selected position relative to said correlation indicia so that the medium of the work tool achieves the selected pattern of the work tool upon the work surface when engaged therewith.

10. The improvement according to claim 9, wherein the settable actuator further comprises:

a lever having an enlarged end member at one end thereof and an elongated end member at an opposite end thereof, and wherein the enlarged end includes (i) a pivot location pivotably coupled to the machine frame, and a cable-receiving mount, where the pivot location is spaced apart from the cable-receiving mount; and a cable member coupled to the cable-receiving mount at one end thereof and coupled to a work tool assembly at the opposite end thereof.

11. The improvement according to claim 10, wherein the settable actuator comprises an elongated rotary handle member having an axis of longitudinal rotation and a cable wrapping portion coupled to the handle member, so that when the handle member is rotated on the axis of longitudinal rotation, the cable is either wound around or unwound from the cable wrapping portion to thereby change the elevation of the work tool.

12. The improvement according to claim 10, wherein the settable actuator comprises a manually powered pedal structure having a first position and a second position and a cable wrapping portion coupled to the pedal structure, so that when the pedal structure is displaced from the first position to the second position the cable is either wound around or unwound from the cable wrapping portion to thereby change the elevation of the work tool.

13. An apparatus for rapidly adjusting the elevation with respect to a work surface of a work tool coupled to a surface maintenance machine, said apparatus comprising:

a work tool that includes a medium exhibiting an effective working length that determines a selected pattern of the work tool upon the work surface when selectively engaged with the work surface;

a first indicia having graduated markings and disposed in a location proximate said work tool so as to provide an indication of the current effective working length of the work tool medium; and an adjustable structure coupled to the work tool so that the elevation of the work tool is adjustable toward and away from the work surface; and a second indicia, disposed in a location proximate said adjustable structure, said second indicia having graduated marking corresponding to said graduated markings of said first indicia so that the adjustable structure is settable to achieve a selected pattern of the work tool upon the work surface when engaged with the work surface in relation to said indication of the current effective working length of the work tool medium.

14. The apparatus according to claim 13, wherein the work toot is a drum-type brush.

15. The apparatus according to claim 13, wherein the work tool is a disk-type brush.

16. The apparatus according to claim 13, wherein the work tool is a drum-type surface maintenance medium.

17. The apparatus according to claim 13, wherein the work tool is a disk-type surface maintenance medium.

18. An improvement to a surface maintenance machine having a work tool assembly coupled thereto, wherein said work tool assembly is operative for raising and lowing a work tool and setting the work tool to a selected height relative to a work surface, and wherein the work tool includes a medium exhibiting an effective working length that determines the selected pattern of the work tool upon the work surface when selectively engaged with the work surface, the improvement comprising:

measurement indicia having graduated markings so as to provide a measurement indication of the current effective working length of the work tool medium;

a settable actuator coupled to the work tool assembly operative to raise and lower the work tool relative to the work surface and set the work tool at a selected height above said work surface; and correlation indicia disposed in a location proximate said settable actuator, said second indicia having graduated marking corresponding to said graduated markings of said measurement indicia so that the settable actuator may be set so that said work tool is a selected height above said work surface in relation set measurement indication.

19. The improvement of claim 18 wherein said actuator is a manually operated actuator, and said improvement further includes an adjustable mechanical stop member associated with said manually operated actuator operative to arrest the manually operated actuator at a selected work tool height.

20. The apparatus according to claim 18, wherein the work tool is a drum-type brush.

21. The apparatus according to claim 18, wherein the work tool is a disk-type brush.

22. The apparatus according to claim 18, wherein the work tool is a drum-type surface maintenance medium.

23. The apparatus according to claim 18, wherein the work tool is a disk-type surface maintenance medium.

24. A surface maintenance machine comprising:

a work tool for selectively conditioning a work surface, wherein said work tool exhibits an effective working medium length indicating working life of said work tool;

measurement indicia having graduated markings associated with the work tool for providing a visual indication of said effective working medium length;

an actuator coupled to the work tool operative to raise and lower the work tool relative to a work surface and capable of setting the work tool at a selected height above said work surface in relation to said effective working medium length;

correlation indicia associated with said actuator having graduated marking corresponding to said graduated markings of said measurement indicia so that the actuator is settable to achieve a selected height above the work tool relative to the work surface in relation to said effective working medium length of the work tool.

25. The apparatus according to claim 24, wherein the work tool is a drum-type brush.

26. The apparatus according to claim 24, wherein the work tool is a disk-type brush.

27. The apparatus according to claim 24, wherein the work tool is a drum-type surface maintenance medium.

28. The apparatus according to claim 24, wherein the work tool is a disk-type surface maintenance medium.

29. An apparatus for elevating a rotary drum-type brush relative to a work surface in relation to the remaining effective working length of external brush bristles associated with the rotary drum-type brush, the apparatus comprising:

an adjustable-elevation frame assembly mechanically coupled to the drum-type brush, and also adapted to be mechanically coupled to a frame member surface maintenance machine for raising and lowering the drum-type brush;

a spacing mechanism including a transportable frame member moveably coupled to the machine frame member and adapted to change the elevation of the longitudinal axis of rotation of the drum-type brush relative to a work surface;

an actuator coupled to the spacing mechanism for controlling the spacing mechanism through a range of travel;

a mechanical stop feature adapted to limit the travel of the actuator to set a minimum elevation for the drum-type brush;

first indicia having graduated markings and disposed in a viewable location adjacent said plurality of bristles so as to provide an indication of the remaining effective working length of the external brush bristles associated with the rotary drum-type brush; and second indicia disposed in a location proximate said actuator, said second indicia having graduated markings corresponding to said graduated markings of said first indicia so that the actuator is settable to achieve an elevation of the rotary drum-type brush relative to a work surface in relation to the remaining effective working length of external brush bristles associated with the rotary drum-type brush.

30. An apparatus according to claim 29, wherein the mechanical stop feature further comprises a slider bar member coupled adjacent a portion of the actuator means.

31. An apparatus according to claim 29, wherein the mechanical stop feature further comprises a set of detent locations in which a control lever arm associated with the actuator is temporarily retainable, and further including a biasing force mechanism coupled to the actuator to retain the control lever arm in said detent locations.

32. An apparatus according to claim 30, wherein, the actuator comprises an elongated sculptural lever including a manually operated control lever arm member at one end thereof and enlarged foot member, said control lever arm member being adapted to be disposed in an elongated slot of a slot member associated with said machine frame, said enlarged foot member having first and second spaced apart attachment locations where said first attachment location is pivotably coupled to said surface maintenance machine frame member, and the spacing mechanism further includes a cable having a first end coupled to the the second one of said attachment locations of the enlarged foot member, and a second end thereof coupled to said transportable frame member.

33. An apparatus according to claim 32, wherein the elongated sculptural lever has an upper portion disposed above the elongate slot, and the enlarged foot member includes a major planar surface and an upwardly extending portion terminating in the upper portion; and wherein the upper portion has a complex substantially cylindrical shape oriented at a obtuse angle relative to said upwardly extending portion and designed to maximize the useful length of the elongate slot so that the elevation of the longitudinal axis of rotation of the drum-type brush changes by a multiple of a travel distance of the elongate sculptural lever in the elongate slot.

34. An apparatus according to claim 29, wherein said bristles have alternating color-coded portions terminating at an end of and displayed along a majority of an axial length of said bristles.

35. An apparatus according to claim 29, wherein the transportable frame member further comprises at least a one of the following set:

a window member affixed to the transportable frame member adjacent the first indicia, a telescoping member coupled to the frame member and having the first indicia displayed on a surface thereof, a folding member coupled to the transportable frame member and having the first indicia displayed on a surface thereof, a portable member removeably coupled to a portion of the transportable frame member and having the first indicia displayed on a surface thereof, a pendulum member, a bubble-type level instrument coupled to a portion of the transportable frame member and having the first set of indicia displayed adjacent the bubble-type level.

36. An apparatus according to claim 29, wherein the first indicia and the second indicia each comprise a different size of the same set of indicia.

37. An apparatus according to claim 32, wherein said spacing mechanism a longitudinal member substantially parallel to the longitudinal axis of rotation of the rotary drum-type brush, and wherein said spacing mechanism further includes a structural member coupled at a first end thereof to the transportable frame member, and coupled at a second end thereof to the actuator.

38. An improvement to a surface maintenance machine having a lever-actuated adjustable-height drum-type brush assembly coupled thereto and including a drum-type brush having bristles exhibiting an effective working length, said improvement comprising:

first indicia having graduated markings and disposed in a location proximate said drum-type brush so as to provide an indication of the current effective working length of the drum-type brush bristles; and a manually operated mechanism coupled to the drum-type brush assembly operable to selectively raise and lower the drum-type brush assembly;

a second indicia disposed in a location proximate said manually operated mechanism, said second indicia having graduated markings corresponding to said graduated markings of said first indicia so that said manually operated mechanism is settable in relation to the indication of the current effective working length of the drum-type brush bristles.

39. The improvement according to claim 38, wherein said first indicia is displayed on a brush support member having an aperture for visually observing said current effective working length of the drum-type brush bristles relative to said graduating marking associated with said first indicia.

40. The improvement according to claim 38, wherein said first indicia is displayed proximate said brush bristles for visually observing said current effective working length of the drum-type brush bristles relative to said graduating marking associated with said first indicia.

41. The improvement according to claim 38, wherein the manually operated mechanism further comprises:

a lever having a first enlarged end and an elongated second end, and wherein the first enlarged end is pivotably coupled to said machine at a first the pivot location, and includes a cable receiving mechanism at a second location spaced apart from said pivot location; and a cable having first end thereof coupled to the cable-receiving mechanism location of said first enlarged end, and having a second end thereof coupled to drum-type brush assembly.

42. The improvement according to claim 38, wherein the manually operated structure comprises an elongate rotary handle member having an axis of longitudinal rotation and a cable wrapping portion coupled to the handle member, so that when the handle member is rotated on the axis of longitudinal rotation, a cable coupled between the drum-type brush member and the rotary handle member is either wound around or unwound from the cable wrapping portion to thereby change the elevation of the drum-type brush assembly.

43. The improvement according to claim 38, wherein the manually operated structure comprises a manually powered pedal structure having a first position and a second position and a cable wrapping portion coupled to the pedal structure, so that when the pedal structure is displaced from the first position to the second position a cable coupled between the drum-type brush member and the pedal structure is either wound around or unwound from the cable wrapping portion to thereby change the elevation of the drum-type brush member.

44. The improvement according to claim 38, further comprising at least a one of the following set: a window member affixed to the frame member adjacent the first set of indicia, a telescoping member coupled to the frame member and having the first set of indicia displayed on a surface thereof, a folding member coupled to the frame member and having the first set of indicia displayed on a surface thereof, a portable member removeably coupled to a portion of the frame member and having the first set of indicia displayed on a surface thereof, a pendulum member disposed adjacent the first set of indicia, a bubble-type level instrument coupled to a portion of the frame member and having the first set of indicia displayed adjacent the bubble-type level.

45. An article of manufacture, comprising:

a drum-type support assembly for rotatably supporting a cylindrical brush on an axis of rotation of the cylindrical brush, wherein said drum-type support assembly includes an elongated flange member adjacent at least one end of the cylindrical brush, and including a first set of bristle measurement indicia displayed thereon;

an actuator pivotably coupled to a surface maintenance machine, said actuator having a travel stop which restricts the movement of the actuator;

a cable having a first end coupled to the drum-type support assembly, and a second end coupled to said actuator;

second indicia displayed adjacent the lever;

wherein said second set of measurement indicia is related to said first set of bristle measurement indicia so that said actuator is settable in relation to said remaining bristle length indicated by said bristle measurement indicia.

* * * * *